United States Patent [19]

Catan

[11] Patent Number: 4,979,432

[45] Date of Patent: Dec. 25, 1990

[54] AIR DIFFUSER WITH ROTATABLY ADJUSTABLE LOUVRES, ESPECIALLY FOR AN AIR CURTAIN GENERATOR

[75] Inventor: Robert S. Catan, Greenlawn, N.Y.

[73] Assignee: Dynaforce Corporation, Old Bethpage, N.Y.

[21] Appl. No.: 421,977

[22] Filed: Oct. 16, 1989

[51] Int. Cl.[5] ..... F24F 13/14

[52] U.S. Cl. ..... 98/36; 98/40.2; 98/40.24; 98/121.1

[58] Field of Search ..... 98/36, 40.2, 40.24, 98/40.28, 114, 121.1, 121.2

[56] References Cited

U.S. PATENT DOCUMENTS

| | | | |
|---|---|---|---|
| 2,557,502 | 6/1951 | Goettl | 98/121.1 |
| 2,600,934 | 6/1952 | Spieth | 98/40.24 X |
| 3,145,641 | 8/1964 | Morrison | 98/36 |
| 3,255,686 | 6/1966 | Larson et al. | 98/36 |
| 3,308,739 | 3/1967 | Gygax | 98/36 |
| 4,621,570 | 11/1986 | Bolton et al. | 98/121.2 |

FOREIGN PATENT DOCUMENTS

| | | | |
|---|---|---|---|
| 402739 | 1/1968 | Australia | 98/36 |

*Primary Examiner*—Harold Joyce
*Attorney, Agent, or Firm*—Ladas & Parry

[57] ABSTRACT

An air diffuser is provided, preferably for an air curtain generator, which consists of a frame within which are located a plurality of louvres. The louvres are striated and rotatably adjustable about respective axes of rotation. To provide for this rotatable adjustment the louvres are mounted on splined shafts which are received in splined receptacles. The splined receptacles are made in nesting sections which are releasably connected together to provide for the loosening of the shafts and adjustable rotation of the shafts and adjustable rotation of the same to positions whereat the shafts and thereby the louvres are locked in position. Some of the shafts are in parallel with the others. Some of the shafts are further mounted in axial extension of other of the shafts. The shafts of louvres which are in axial extension of one another are in nesting relationship and for this purpose are provided with polygonal cross-sections which prevent rotation of a relative nature therebetween.

13 Claims, 2 Drawing Sheets

AIR DIFFUSER WITH ROTATABLY ADJUSTABLE LOUVRES, ESPECIALLY FOR AN AIR CURTAIN GENERATOR

FIELD OF INVENTION

This invention relates to structures for controlling air flow and more particularly to arrangements of louvres which permit the rotatable adjustment of the same. The invention relates particularly to air diffusers for controlling the flow of air especially in association with air blower arrangements for producing air screens or curtains.

BACKGROUND OF THE INVENTION

U.S. Pat. No. 4,450,755 which issued on May 29, 1984 discloses a blower apparatus which is especially suitable for the generation of an air curtain, screen or barrier. The apparatus described in this patent includes a blower having a plurality of blades arranged in cylindrical disposition. A guide encircles the blower but extends axially beyond the blower to provide for the generation of an air stream, the width of which is greater than that of the blower. A deflector or interceptor plate in the form of a scroll is arranged to prevent air from circulating in axial direction back into the blower and is provided to improve the effectiveness of generation of the air stream which flows tangentially out of the blower apparatus through a vent through which the air stream is discharged.

It has now been found that it may be desirable to control the flow of the air discharged through the abovementioned vent as well as in other type of apparatus. Such ability provides for a more particular control of the disposition of the air curtain and also provides for situations wherein the vent in the blower apparatus may not be appropriately arranged to direct the air curtain in a particularly desired direction. For this purpose it has been found, in accordance with the present invention, that it is desirable to provide a plurality of adjustable louvres at the abovementioned vent to provide for the control of the flow of air therethrough.

Venting arrangements have long been known and some of these arrangements are shown by way of example in U.S. Pat. Nos. 1,725,353; 1,753,587; 1,872,794; 3,180,246; 3,270,657; and 3,601,034.

In U.S. Pat. No. 1,725,353, R. M. Hinrich discloses an adjustable air diffuser in which an arrangement is provided for retaining each of a plurality of blades in different positions of adjustment independently of the other blades. For this purpose elongated loops are pivotally connected to the blades and are held by a clamping arrangement associated therewith. Such an arrangement results in the accumulation of dirt and grime at a location whereat these contaminants are prevalent.

F. M. Young discloses in U.S. Pat. No. 1,753,587 the use of air deflectors adjustably mounted to control the flow of a current of air which has been impelled by a fan propeller. These deflectors are mounted at one of their edges and can be adjusted in order to control the flow of air. The nature of the adjustment is not set forth in any detail and appears to be a simple matter of manual control.

In U.S. Pat. No. 1,872,794, Q. G. Noblitt et al illustrate a plurality of pivotally mounted shutters. These shutters are utilized to direct air flow. These shutters appear to be manually controllable and no description is offered of the manner in which these shutters are fixed in position.

In U.S. Pat. 3,180,246, E. H. Johnson reveals an air control device such as a diffuser or the like. Therein are provided a number of shutter arrangements in which provision is made for rotational adjustment of the same. To retain the blades in their positions a frictional device is employed involving the use of a pressure plate. As will become apparent hereinafter such an arrangement is substantially different from what is offered in accordance with the present invention.

In U.S. Pat. No. 3,270,657, R. C. Jaye shows an air outlet having angularly adjustable louvres. The louvres are adjustably accommodated in receptacles wherein they are retained by a friction fit which is enhanced by the particular construction of the louvres.

In U.S. Pat. No. 3,601,034, J. Thorne reveals a diffuser having a frame made of L-shaped members with a plurality of louvres extending between the L-shaped members. The louvres have pins extending through openings in the frame members with resilient fingers engaging the louvre pins and securing the louvres against inadvertent rotation thereof.

None of the aforesaid louvre arrangements nor any other structures known to me are anticipatory of the concept developed in accordance with the invention and described hereinbelow.

SUMMARY OF INVENTION

It is an object of the invention to provide improved louvre arrangements and air diffusers compared with the abovenoted prior art arrangements.

It is another object of the invention to provide an improved louvre support system which enables louvres to be rigidly held in fixed position at incrementally spaced positions about an axis of rotation.

It is a further object of the invention to provide an improved air diffuser control capable of arranging louvres in a multitude of fixed positions.

Yet another object of the invention is to provide an improved louvre control providing for rigid support while being nevertheless adapted for facilitating installation and adjustment.

In achieving the above and other of its objectives, there is provided in accordance with the invention apparatus comprising a rotatable louvre having an axis of rotation and being adapted to control a flow of air. In connection therewith there is provided an arrangement to lock the louvre selectively in one of a plurality of angularly displaced positions relative to the aforementioned axis. Preferably these positions are regularly spaced about the axis. In a preferred embodiment these positions form a circle about this axis.

According to a feature of the invention each louvre has a surface of striated configuration to increase strength to weight ratio.

In further accordance with a preferred embodiment the arrangement to lock the louvre in the various positions includes a splined shaft supporting the louvre and a splined receptacle for receiving the splined shaft. The receptacle is preferably provided with a plurality of relatively displaceable sections which are connected by connecting devices for holding the sections together to lock the associated shaft in a selected position.

In accordance with a feature of the invention the displaceable sections mentioned above have a nesting conformation for being guided together to define the splined receptacle. This arrangement will be described in greater detail hereinbelow.

In further accordance with the invention there is provided a frame defining an opening for confining the flow of air, the louvre or louvres being arranged in transverse positions in the opening and being supported by the frame. The louvres may be generally considered as being in parallel with one another. Some of the louvres are in axial extension of other of the louvres. The shafts in endwise relationship with one another or in axial extension of one another are provided with shafts which are in endwise nesting relationship but which are rotationally locked together so that the louvres are adjustable together when they are in this endwise axial extension of one another.

In a preferred embodiment the shafts which are in nesting relationship are of polygonal cross-section and fit into receptacles of polygonal cross-section in the mating or nesting shaft. The polygonal shaft which fits into the polygonal receptacle is tapered to facilitate insertion into the polygonal receptacle.

As will be shown in greater detail hereinbelow the louvres are provided with end caps upon which the aforementioned shafts are mounted. Moreover, reference will be made in greater detail hereinbelow to the provision of air curtain generating arrangements including casings provided with vents at which the above-mentioned louvres are supported.

The above objects and advantages of the invention will be more readily understood in conjunction with the detailed description which follows hereinafter as illustrated in the accompanying drawings.

BRIEF DESCRIPTION OF DRAWING

In the drawing:

FIG. 1(*a*) illustrates a fragmentary portion of the arrangement of FIG. 1 illustrating another mounting posture for the air diffuser of the invention;

DETAILED DESCRIPTION

Figure 1:
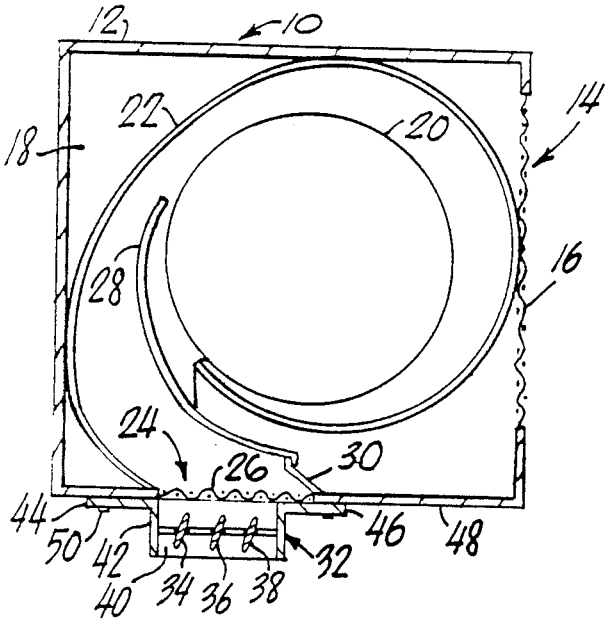
FIG. 1 is a cross-sectional view of an air curtain generator provided with a louvre arrangement in accordance with the invention.
Figure 1A:
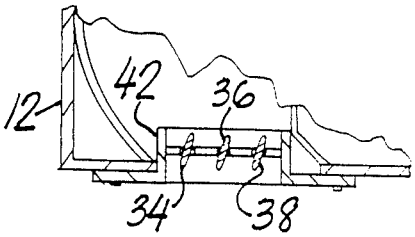
Figure 2:
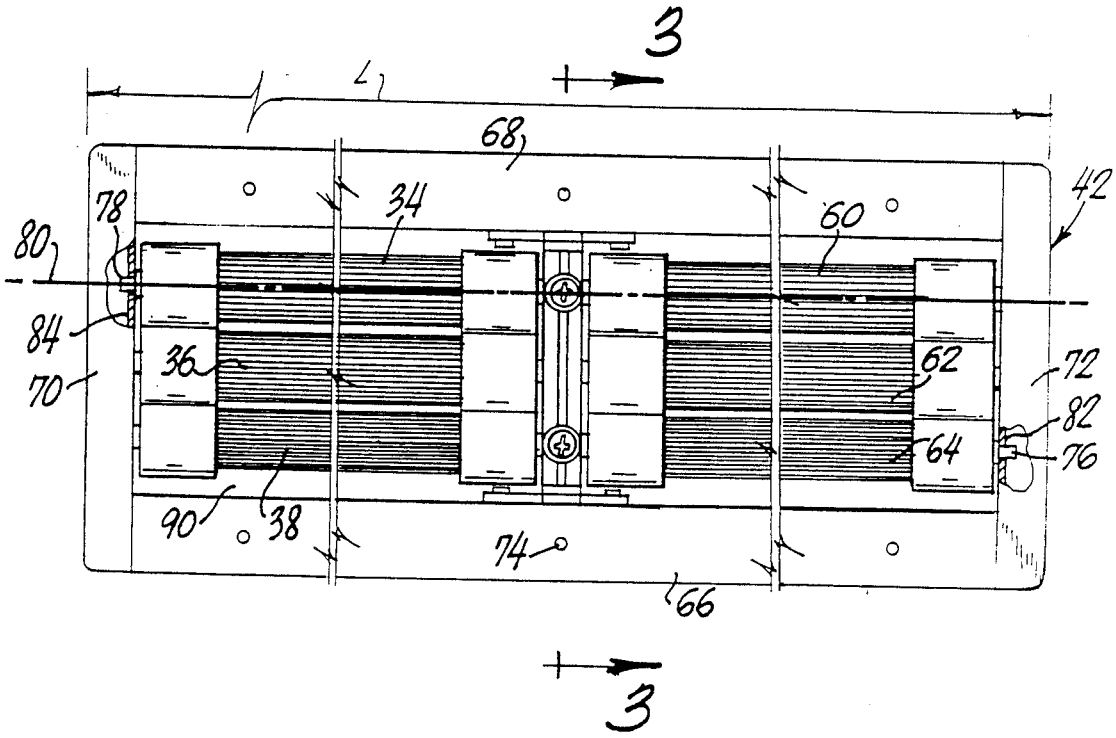
FIG. 2 is a bottom view of the air diffuser of the invention, partially broken away to illustrate that the air diffuser may be designed with various lengths.
Figure 3:
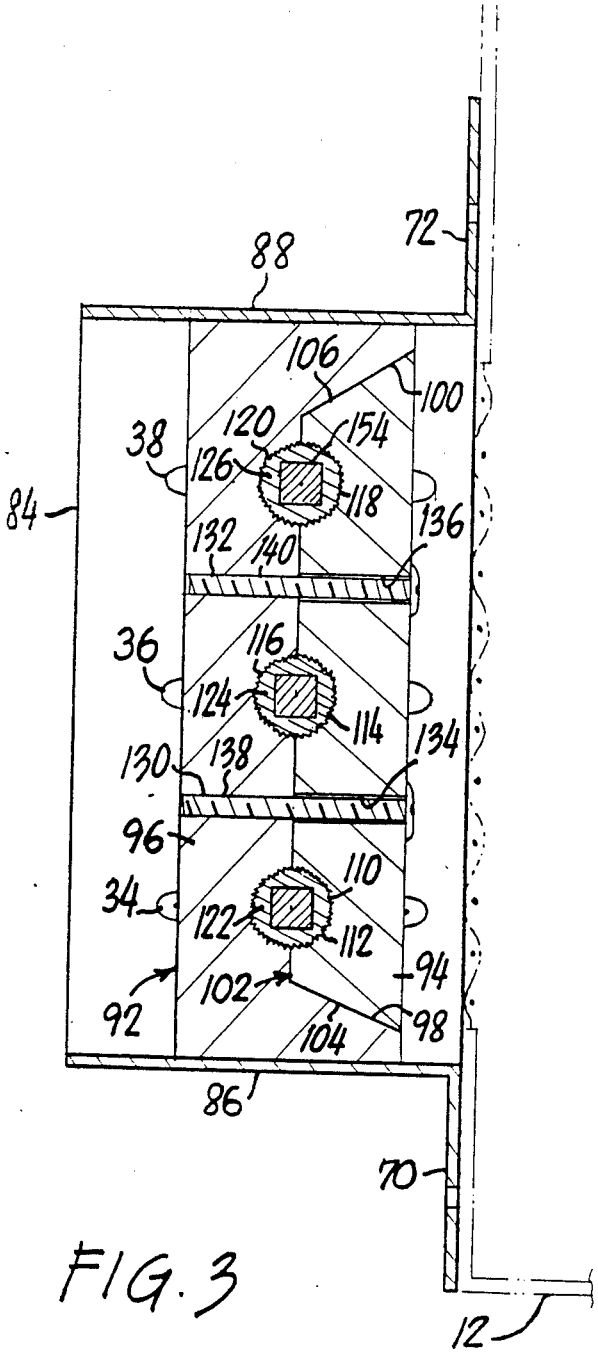
FIG. 3 is a cross-sectional view taken along line 3—3 of FIG. 2.

FIG. 1 illustrates at 10 the air blower arrangement disclosed in U.S. Pat. No. 4,450,755 which issued May 29, 1984. It includes a casing 12 having an air inlet opening 14 provided with a screen 16 to prevent the entry of solid objects such as insects and the like. In the chamber 18 enclosed by the casing 12 is a blower diagrammatically illustrated at 20 consisting of a plurality of vanes arranged in a cylindrical form. Also present in the chamber 18 is a scroll-shaped member 22 having the function of directing air flow towards a vent or opening 24 covered by a screen 26. A deflector plate 28 having the function of preventing return of air axially into the blower is furthermore provided. It is mounted on a support 30.

In accordance with the invention there is provided the diffuser 32 consisting of a plurality of louvres such as shown at 34,36 and 38. These louvres are adjustable and operate within the throat 40 of casing 42 to control the direction of air flow thereby to control the disposition of the air curtain formed by the discharge of air through the opening 24. Casing 40 is mounted by flanges 44 and 46 on the bottom 48 of casing 12 by means of appropriate fastening elements such as bolts 50.

FIG. 1(*a*) illustrates a slightly different disposition of the air diffuser 32 in that the wall or casing 42 thereof extends inwardly into the casing 12. The vanes such as indicated at 34,36 and 38 however continue to perform the function of controlling air flow during the exit of air from the interior chamber of the casing 12. As will be shown this is effected by enabling a rotation of the louvres into a fixed position whereat they are locked according to a feature of the invention as will become more apparent hereinafter.

FIGS. 2–5 illustrate the preferred version of air diffuser provided in accordance with the invention and illustrated in combination with an air blower arrangement in FIGS. 1 and 1(*a*). The air diffuser of the invention includes a plurality of louvres. As indicated in FIGS. 1 and 1(*a*) there are included louvres 34,36 and 38. These louvres are in parallel with one another as are additional louvres 60,62 and 64. There may be any number of louvres provided in axial extension of one another and the length L of the air diffuser arrangement of the invention may be varied widely as required by the air flow which is to be controlled. More particularly, louvre 34 is in axial extension of louvre 60 and vice versa as are pairs of louvres 36 and 62 and 38 and 64. These louvres are accommodated within casing 42 which is provided with bottom flanges 66 and 68 as well as end flanges 70 and 72. These flanges may be provided with openings such as indicated at 74 to provide for the use of fastening elements such as bolts by means of which the air diffuser of the invention is physically associated with and mounted on an associated piece of apparatus such as illustrated in FIGS. 1 and 1(*a*).

A portion of flanges 70 and 72 is broken away to illustrate shafts or pins 76 and 78. These are illustrative of the pins or shafts upon which the louvres are mounted for free rotation. At the other ends of the louvres are provided mounting arrangements by means of which the louvres are incrementally rotated about their respective axes, one such axis being illustrated at 80 and being common to louvres 34 and 60. Pins 76 and 78 are respectively mounted in end walls 82 and 84, these end walls being part of the casing of the air diffuser. The walls between the end walls 82 and 84 are shown at 86 and 88 to complete the definition of an air flow passage 90 by means of which air exits in the form of a curtain from the chamber 12 via vent 24 (see FIG. 1).

Between walls 86 and 88 extends a separator or support wall 92. It consists of sections 94 and 96. Section 94 is of trapezoidal conformation and includes sloped end walls 98 and 100. Section 96 defines a trapezoidally-shaped receptacle 102 having sloped walls 104 and 106. Wall 98 forms a camming surface for wall 104 while wall 100 forms a camming surface for wall 106. These camming surfaces enable the sections 94 and 96 to be brought together in nesting relationship. The purpose of this is to provide for the uniting of receptacle sections 110 and 112, 114 and 116, and 118 and 120. These splined receptacle sections cooperate to form circular splined receptacles which accommodate splined shafts or pins 122,124 and 126. As will be shown these splined shafts support louvres 34,36 and 38.

The purpose of the splined shafts and splined receptacles is to permit a controlled incremental variation of the rotational disposition of the various louvres. The splines may be dimensioned for example so that the louvres may be incrementally varied in steps having an angular magnitude of from about 1 to 15 degrees. Sections 94 and 96 are held together by fastening elements such as bolts 130 and 132. These bolts fit freely through bores 134 and 136 to be engaged in threaded receptacles 138 and 140. By loosening the bolts the sections 94 and 96 may be given a relative movement away from one another to loosen the grip of the receptacles on the associated splined shafts 122,124 and 126 so that the louvres 34,36 and 38 may be rotated independently and separately to any desired degree to give them an appropriate posture in the throat or passage. Thereafter the bolts 134 and 136 may be tightened to bring sections 94 and 96 together thereby to clamp the splined receptacles together to grip the splined shafts tightly therein thereby to fix the relative postures of the associated louvres.

Figure 4:
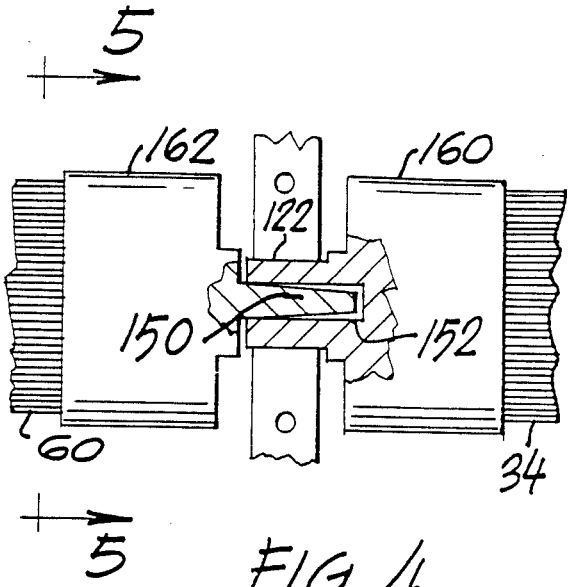
FIG. 4 is an enlarged view of a detail of the construction of FIGS. 2 and 3 illustrating the nesting relationship between the shafts of louvres arranged in endwise extension of one another in accordance with the invention.

As mentioned hereinabove, louvre 60 is in axial extension of louvre 34, louvre 62 is in axial extension of louvre 36, and louvre 64 is in axial extension of louvre 38. The connection between these louvres is illustrated in FIG. 4. Therein is seen by way of example that shaft or pin 150 is accommodated within a bore 152 axially aligned within for example shaft 122 wherein the bore is axially aligned. As appears in FIG. 3 the bore 152 as well as the pin 150 is provided with a polygonal cross-section as indicated at 154. Since the pin and receptacle receiving the same have matching polygonal configurations, rotation of the shaft 122 will cause a concomitant rotation of the shaft or pin 150. Thus, for example, louvre 34 and louvre 60 will rotate together upon adjustment of either of these louvres. The same is true of pairs of louvres 36 and 62 and 38 and 64 although one pair of louvres may be rotatev to a greater or lesser degree than the other pairs of louvres.

Pins or shafts 122 and 150 (as well as the other corresponding pins and shafts are mounted on end caps 160 and 162. The ends of the corresponding louvres are received in and supported by these end caps which may be for example fabricated of plastic or hard rubber or the like.

Figure 5:
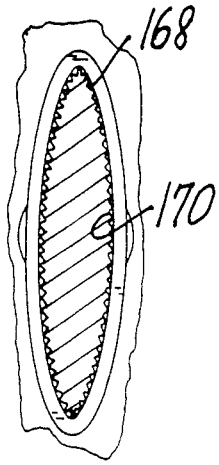
FIG. 5 is a cross-sectional view taken of a louvre mounting arrangement along line 5—5 of FIG. 4.

The shapes of these end caps are illustrated more specifically in FIG. 5 wherein it is seen that these end caps are of oval shape and are provided with oval openings 168 within which are accommodated the ends of the respective louvres. Also illustrated in FIG. 5 are the striations 170 with which the surfaces of the respective louvres are scored. These striations are preferably longitudinally disposed along the respective louvres and are parallel to the corresponding axes such as the axis 80 (see FIG. 2) which constitutes the various axes of the pairs of louvres described hereinabove. The striations have a depth of from about 005–030 inches. The striated surface makes for a stiffer blade with less weight than an unstriated blade. In addition, the striations serve to aid in the perception of which direction the louvres are tilted and how they are inclined. The provision of these striations constitutes another of the features of the invention whereby a more efficient and effective air control is provided.

From the above it will be seen that in accordance with the invention there is provided an apparatus which includes a rotatable louvre having an axis of rotation and being adapted to control a flow of air, there being furthermore provided an arrangement to lock the louvre selectively in one of a plurality of angularly displaced positions relative to the axis. It will also be noted that these positions are regularly spaced about the aforementioned axis and that the positions preferably form a circle around this axis. It has also been noted that the louvres have surfaces of striated configuration to improve mechanical performance and appearance.

There will now be obvious to those skilled in the art many modifications and variations of the structure set forth hereinabove. These modifications and variations will not depart from the scope of the invention if defined by the following claims.

What is claimed is:

1. Apparatus comprising a rotatable louvre having an axis of rotation and being adapted to control a flow of air, and means to lock said louvre selectively in one of a plurality of angularly displaced positions relative to said axis, said positions being regularly spaced about said axis, and forming a circle around said axis, said louvre having a surface of striated configuration to improve mechanical performance and maintain appearance.

2. Apparatus as claimed in claim 1 comprising air curtain generating means including a casing provided with a vent and means to discharge air through said vent to form an air curtain, said louvre being supported at said vent to control the discharge of air.

3. Apparatus comprising a rotatable louvre having an axis of rotation and being adapted to control a flow of air, and means to lock said louvre selectively in one of a plurality of angularly displaced positions relative to said axis, said positions being regularly spaced about said axis, and forming a circle around said axis, said means comprising a splined shaft supporting said louvre and a splined receptacle means defining a splined receptacle for receiving said splined shaft, said receptacle means including relatively displaceable sections and connecting means for holding the sections together to lock said shaft in a selected position.

4. Apparatus as claimed in claim 3 wherein said displaceable sections have a nesting conformation for being guided together to define said splined receptacle.

5. Apparatus as claimed in claim 4 wherein said connecting means includes at least one bolt engaging the displaceable sections to hold the same together.

6. Apparatus as claimed in claim 4 further comprising a frame defining an opening for confining the flow of air, said louvre being arranged in transverse position in said opening.

7. Apparatus as claimed in claim 6 comprising a plurality of further louvres in parallel with the first said louvre, and means to lock said further louvres in respective angularly displaced positions.

8. Apparatus as claimed in claim 6 comprising a further louvre in axial extension of the first said louvre, said further louvre including a shaft in endwise nesting relation with the shaft of the first said louvre and being rotationally locked thereto so that the louvres are rotatable together.

9. Apparatus as claimed in claim 8 wherein the first said shaft includes a receptacle of polygonal cross-section and the shaft of said further louvre is of matching polygonal cross-section but is tapered to facilitate insertion into the polygonal receptacle.

10. Apparatus as claimed in claim 9 comprising end caps on said louvres and supporting said shafts.

11. Apparatus as claimed in claim 6 comprising a shaft on said louvre and rotatably accommodated in said frame.

12. Apparatus as claimed in claim 9 comprising air curtain generating means including a casing provided with a vent and means to discharge air through said vent to form an air curtain, said louvre being supported at said vent to control the discharge of air.

13. Apparatus as claimed in claim 3 wherein the positions are spaced at a distance in the range of from about 1 to 15 degrees.

* * * * *